US008381807B2

(12) United States Patent
Jackson et al.

(10) Patent No.: US 8,381,807 B2
(45) Date of Patent: Feb. 26, 2013

(54) HYDRAULICALLY-ACTUATED PROPELLANT STIMULATION DOWNHOLE TOOL

(75) Inventors: Steve Jackson, Richmond, TX (US); Stan Wall, Richmond, TX (US)

(73) Assignee: Summit Downhole Dynamics, Ltd., Midland, TX (US)

( * ) Notice: Subject to any disclaimer, the term of this patent is extended or adjusted under 35 U.S.C. 154(b) by 395 days.

(21) Appl. No.: 12/637,225

(22) Filed: Dec. 14, 2009

(65) Prior Publication Data

US 2011/0139433 A1 Jun. 16, 2011

(51) Int. Cl.
*E21B 43/00* (2006.01)

(52) U.S. Cl. ..... 166/63; 166/317; 166/318; 166/334.4

(58) Field of Classification Search ..... 166/63, 166/334.4, 317, 373, 318
See application file for complete search history.

(56) References Cited

U.S. PATENT DOCUMENTS 2,970,647 A * 2/1961 Scott ..... 166/63
5,775,426 A 7/1998 Snider et al.

* cited by examiner

*Primary Examiner* — Giovanna Wright

(57) ABSTRACT

A hydraulically-actuated propellant stimulation downhole tool for hydrocarbon wells. According to one embodiment of the invention, the tool comprises a first section having an internal sidewall defining at least a portion of a flowpath, and a ported outer sidewall. A propellant volume having at least a portion within said first section. An annular portion has at least one pressure chamber having an end positioned adjacent to the propellant volume and an inlet providing a communication path to said flowpath. A detonator assembly is located within each pressure chamber proximal to the propellant volume such that detonation of the assembly causes detonation of the propellant volume. A firing pin is propelled toward the detonation assembly by providing communication between the pressure chamber and the flow path, causing a pressure differential between the pressure isolated ends of the firing pin.

21 Claims, 4 Drawing Sheets

HYDRAULICALLY-ACTUATED PROPELLANT STIMULATION DOWNHOLE TOOL

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a well stimulation tool for oil and/or gas production. More specifically, the invention is a hydraulically-actuated propellant stimulation downhole tool for use in a hydrocarbon well.

2. Description of the Related Art

In hydrocarbon wells, fracturing (or "fracing") is a technique used by well operators to create and/or extend a fracture from the wellbore deeper into the surrounding formation, thus increasing the surface area for formation fluids to flow into the well. Fracing may be done by either injecting fluids at high pressure (hydraulic fracturing), injecting fluids laced with round granular material (proppant fracturing), or using explosives to generate a high pressure and high speed gas flow (TNT or PETN up to 1,900,000 psi) and propellant stimulation.

Gas generating propellants have been utilized in lieu of hydraulic fracturing techniques as a more cost effective manner to create and propagate fractures in a subterranean formation. In accordance with conventional propellant stimulation techniques, a propellant is ignited to pressurize the perforated subterranean interval either simultaneous with or after the perforating step so as to propagate fractures therein.

For example, U.S. Pat. No. 5,775,426 (issued Jul. 7, 1998), which is incorporated by reference herein, describes a perforating apparatus wherein a shell of propellant material is positioned to substantially encircle a shaped charge. The propellant material is ignited due to shock, heat, and/or pressure generated from a detonated charge. Upon burning, the propellant material generates gases that clean perforations formed in the formation by detonation of the shaped charge and which extend fluid communication between the formation and the well bore.

BRIEF SUMMARY OF THE INVENTION

A preferred embodiment of the invention having a flowpath therethrough includes a first section having an internal sidewall, a ported outer sidewall, and at least a portion of a propellant volume within the first section. At least one pressure chamber is disposed in an annular portion between the outer surface of the tool and the flowpath, with a first end of each pressure chamber positioned adjacent to the propellant volume. A detonator assembly is positioned in each pressure chamber proximal to the propellant volume to, when actuated, cause ignition of the propellant. Actuation of the detonator assembly is caused by impact of a primer by a firing pin, which is caused to move by the pressure differential between the flowpath and a portion of the pressure chamber. Ignition of the propellant causes pressure waves to be directed radially away from the tool through a plurality of pressure ports disposed in the exterior surface of the tool, and into the surrounding formation.

Also according to the preferred embodiment, a plurality of flow ports is disposed through the exterior surface to provide for fluid flow into and out of the flowpath. A moveable sleeve assembly operates to prevent and permit fluid flow through the flow ports, depending on its position. In a first position, an insert sleeve substantially prevents fluid flow through the flow ports, while in a second position fluid flow is substantially permitted. The moveable sleeve assembly also prevents or allows pressure communication between the flowpath and each pressure chamber to cause application of a hydraulic force to the firing pin.

DETAILED DESCRIPTION OF THE INVENTION

When used with reference to the figures, unless otherwise specified, the terms "upwell," "above," "top," "downwell," "below," and "bottom," and like terms are used relative to the direction of normal production through the tool and wellbore. Thus, normal production of hydrocarbons migrates through the wellbore and production string from the downwell to upwell direction without regard to whether the tubing string is disposed in a vertical wellbore, a horizontal wellbore, or some combination of both. In the figures, the arrow depicting flowpath 30 is pointing in the "downwell" direction (i.e., opposite the normal direction of fluid flow in the tool during production).

Figure 1:
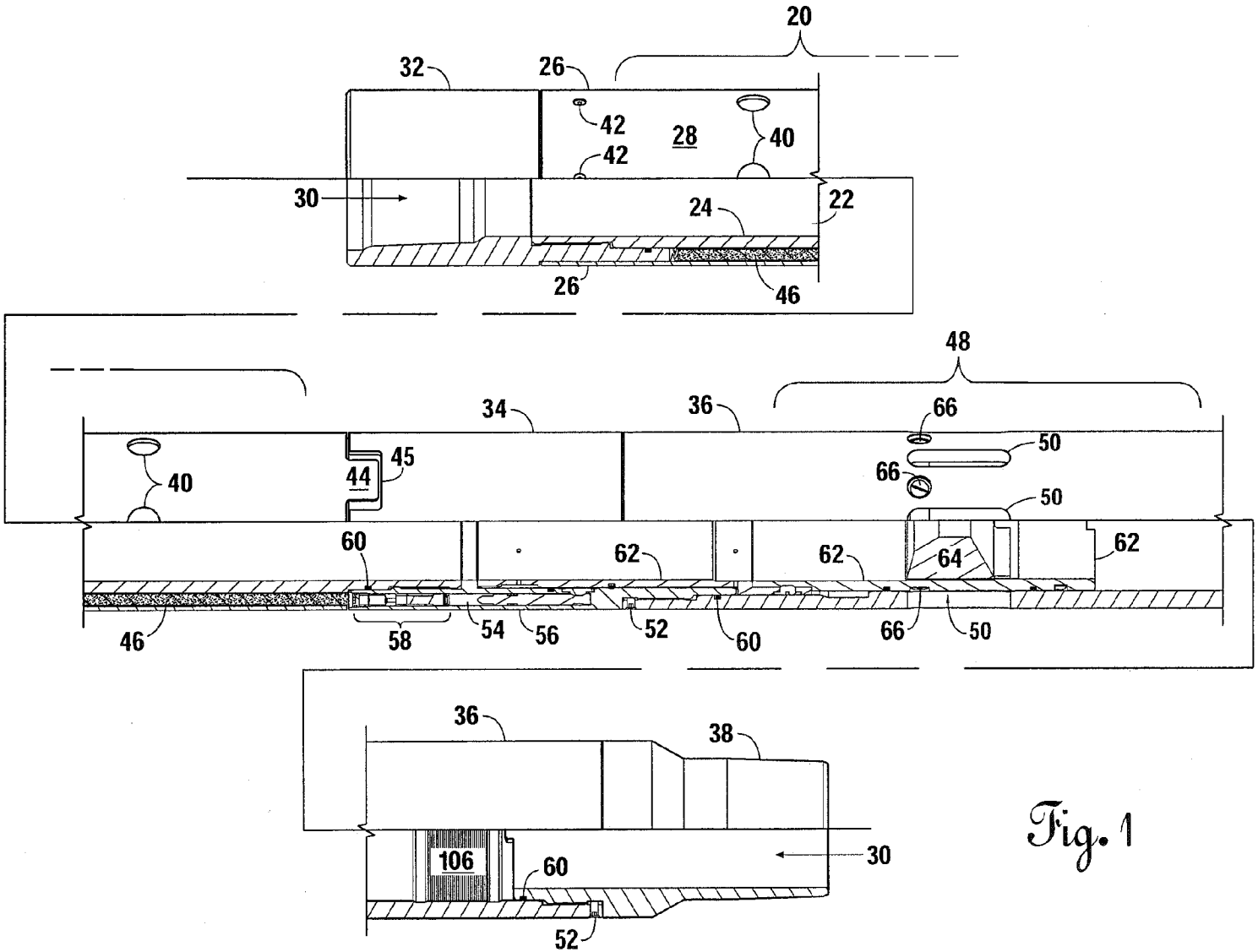
FIG. 1 is a partial sectional elevation of the preferred embodiment of the present invention.

FIG. 1 depicts a partial sectional elevation of a preferred embodiment of the present invention, which comprises a first section 20 having a mandrel 22 with an internal sidewall 24 and a ported sleeve 26 having a ported outer sidewall 28. A flowpath 30 through the tool is partially defined by the substantially cylindrical internal sidewalls of the mandrel 22, a top connection 32, a middle sub 34, a ported housing 36, and a bottom connection 38. The mandrel 22 is threadedly attached to the top connection 32 and the middle sub 34 at its upper and lower ends, respectively. A cylindrical propellant volume 46 is adjacent to and between the mandrel 22 and the ported sleeve 26.

The ported sleeve 26 has a plurality of circular pressure ports 40 spaced equally radially around the outer sidewall 28, and is attached to the top connection 32 with a plurality of low head cap screws 42. The bottom end of the ported sleeve 26 is attached to the upper end of the middle sub 34 with a series of interlaced tabs 44 positioned in slots 45 disposed in the outer surface of the middle sub 34.

A second section 48 of the tool includes a plurality of oblong flow ports 50 that define a fluid communication path between the flowpath 30 and the exterior of the tool. The flow ports 50 are equally spaced around, and disposed through, the cylindrical ported housing 36, which has an upper end connected to the lower end of the middle sub 34 with a plurality of circumferentially-aligned grub screws 52, and a lower end threadedly attached to the bottom connection 38. Sealing rings 60 are positioned throughout the embodiment to prevent undesired fluid communication between the various elements, except through the flowpath 30 and through the plurality of flow ports 50.

A cylindrical pressure chamber 54 is disposed longitudinally through a annular portion 56 of the middle sub 34. A detonator assembly 58 and firing pin 90 are located within the pressure chamber 54, with the detonator assembly 58 located proximal to the upper end of the pressure chamber 54.

The middle sub 34 and ported housing 36 enclose a moveable sleeve assembly 62 having an attached ball seat 64 for selectively allowing communication through the flow ports 50 to the surrounding formation, as will be described infra. The sleeve assembly 62 is anchored in a first position by a plurality of circumferentially-aligned shear pins 66.

Figure 2:
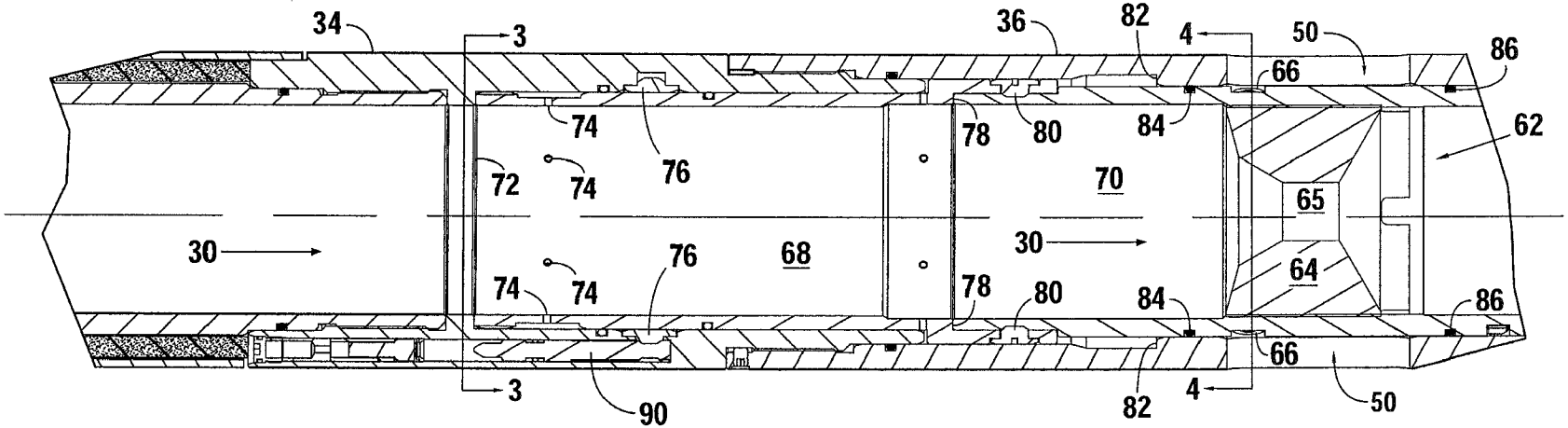
FIG. 2 is a sectional elevation of a portion of the preferred embodiment more fully disclosing the middle sub and piston sleeve.

FIG. 2 is a sectional view of a portion of the preferred embodiment including the middle sub 34 and sleeve assembly 62, which comprises a piston sleeve 68 coupled to an insert sleeve 70. The sleeve assembly 62 is moveable between a first position and a second position, wherein in the first position the sleeve assembly 62 prevents fluid communication between the flowpath 30 and the exterior of the tool through the flow ports 50. In the first position, the upper end of the piston sleeve 68 abuts a bottom profile 72 of the middle sub 34 to define a portion of the flowpath 30. A first plurality of ports 74 provides a fluid communication path to the exterior of the piston sleeve 68. A radially contractible firing pin locking key 76 is disposed circumferentially around the piston sleeve 68.

A lower section of the piston sleeve 68 has a larger interior diameter than an upper section. In the first position, the upper end of the insert sleeve 70 initially abuts the shoulder 78 defining the top end of the second portion, and is coupled thereto with a circumferentially-positioned expandable piston locking key 80. The insert sleeve 70 is initially secured to the ported housing 36 with shear screws 66. Upper and lower sealing rings 84, 86 are circumferentially disposed around the insert sleeve 70 to isolate the flow ports 50 from the flowpath 30, thus substantially preventing communication between the flowpath 30 and the exterior of the tool.

Figure 3:
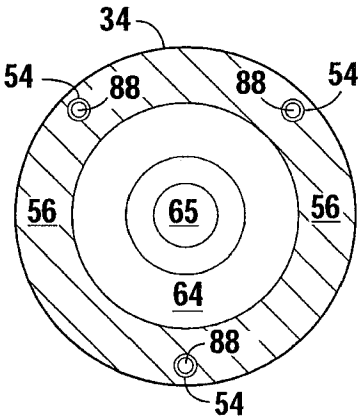
FIG. 3 is a sectional elevation through section line 3-3 of FIG. 2.

FIG. 3 is a sectional view through section line 3-3 of FIG. 2 more fully disclosing the positioning of the three pressure chambers 54 disposed longitudinally within the annular portion 56 of the middle sub 34, and showing first ends 88 of firing pins 90 (see FIG. 2), which are orientated in the upwell direction.

Figure 4:
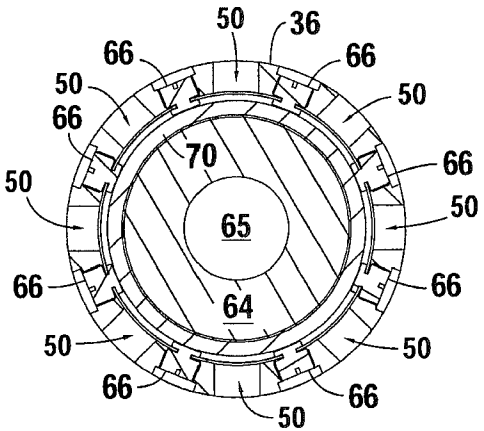
FIG. 4 is a sectional elevation through section line 4-4 of FIG. 2

FIG. 4 more fully discloses the positioning of the shear screws 66 to secure the insert sleeve 70 to the ported housing 36. The flow ports 50 are spaced equally radially around the ported housing 36. The ball seat 64 defines an orifice 65 composing a portion of the flowpath 30.

Figure 5:
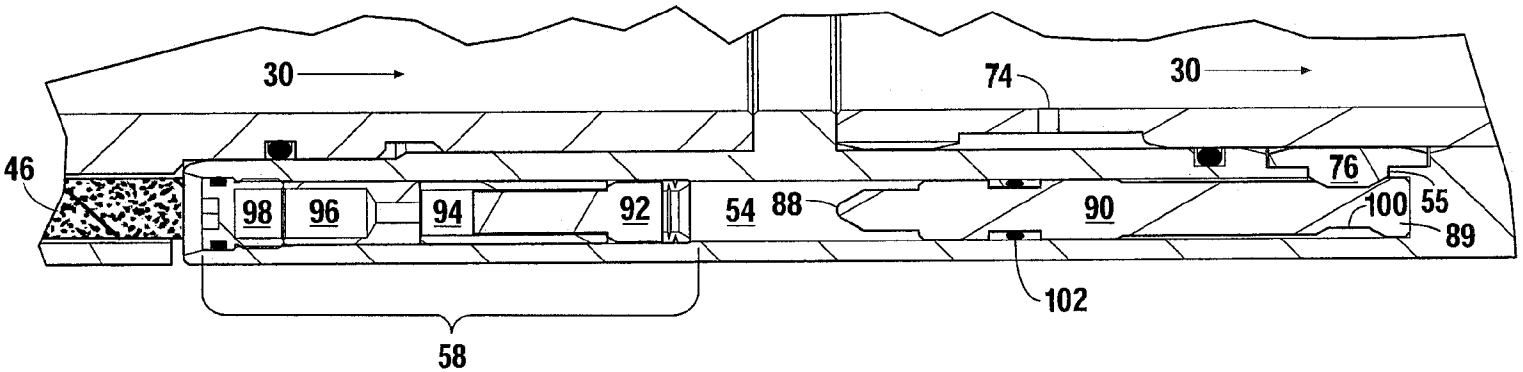
FIG. 5 is a sectional elevation of a pressure chamber and firing pin of the preferred embodiment.

FIG. 5 is a sectional view of the detonator assembly 58 and firing pin 90. The firing pin 90 is within pressure chamber 54 proximal to an inlet 55, and is retained in position by the firing pin locking key 76 engaged with a retention groove 100 circumferentially disposed around the firing pin 90. The first end 88 of the firing pin 90 is pressure isolated from the second end 89 with a sealing ring 102. The inlet 55 of each chamber 54 provides a fluid communication path to the flowpath 30.

The detonator assembly includes a primer 92, primer case 94, shaped charge 96, and an isolation bulkhead 98. The primer 92 is spaced above the firing pin 90 within the primer case 94. The shaped charge 96 is positioned above and adjacent to the primer case 94. The isolation bulkhead 98 is positioned adjacent the shaped charge 94 and proximal to the propellant volume 46. In this position, detonation of the shaped charge will cause corresponding ignition of the propellant volume 46.

Figure 6:
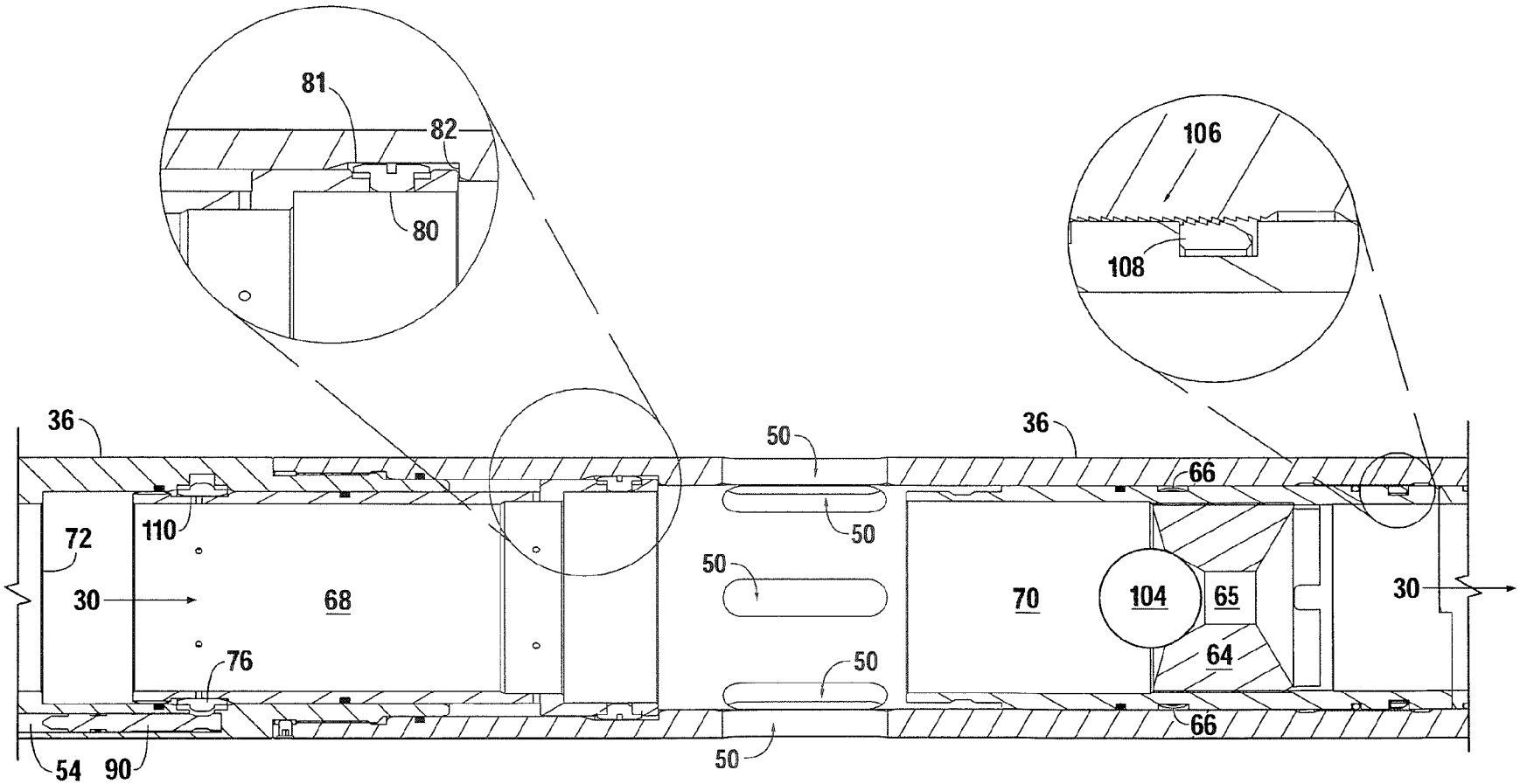
FIG. 6 is a sectional elevation of a portion of the preferred embodiment wherein the sleeve assembly is in a disengaged state in a second position.

FIG. 6 is a sectional elevation of the preferred embodiment wherein the sleeve assembly 62 comprising the piston sleeve 68 and insert sleeve 70 is in a second position to allow fluid communication between the flowpath 30 and the surrounding formation through the flow ports 50 of the ported housing 36. To shift the sleeve assembly 62 to this second position from the first position shown in FIG. 1, an appropriately-sized ball 104 is caused to flow down the wellbore and to engage the ball seat 64. Engagement of ball 104 with the ball seat 64 seals off the flowpath 30 to prohibit fluid flow in the downwell direction through the orifice 65. Thereafter, the well operator can cause the pressure within the flowpath 30 to exceed the shear strength of the shear pins 66 attaching (in the first position) the insert sleeve 70 to the ported housing 36, which causes the shear pins 66 to fracture and detach the insert sleeve 70. In FIG. 6, the shear pins 66 are shown in a sheared state.

After shearing the pins 66, increased fluid pressure within the flowpath 30 causes the insert sleeve 70 and piston sleeve 68 to move downwell until the lower section of the piston sleeve 68 contacts an inner shoulder 82 of the piston housing 36. In this position, the piston locking key 80 expands into an adjacent flanged section 81 and decouples the insert sleeve 70 from the piston sleeve 68. The insert sleeve 70 is thereafter allowed to continue downwell under the flowpath pressure until it contacts the bottom connection 38 (see FIG. 1). The ported housing 36 further includes a locking section 106 that engages a ratchet ring 108 circumferentially disposed around the insert sleeve 70 to prevent upwell movement of the insert sleeve 70 after moving into the locking section 106.

Movement the sleeve assembly 62 to the second position causes hydraulic actuation of the firing pin 90 as follows. Engagement of the piston sleeve 68 with the interior shoulder 86 positions an outer groove 110 to allow the firing pin locking key 76 to radially contract thereinto. This contraction causes the firing pin locking key 76 to disengage from the firing pin 90.

Figure 7:
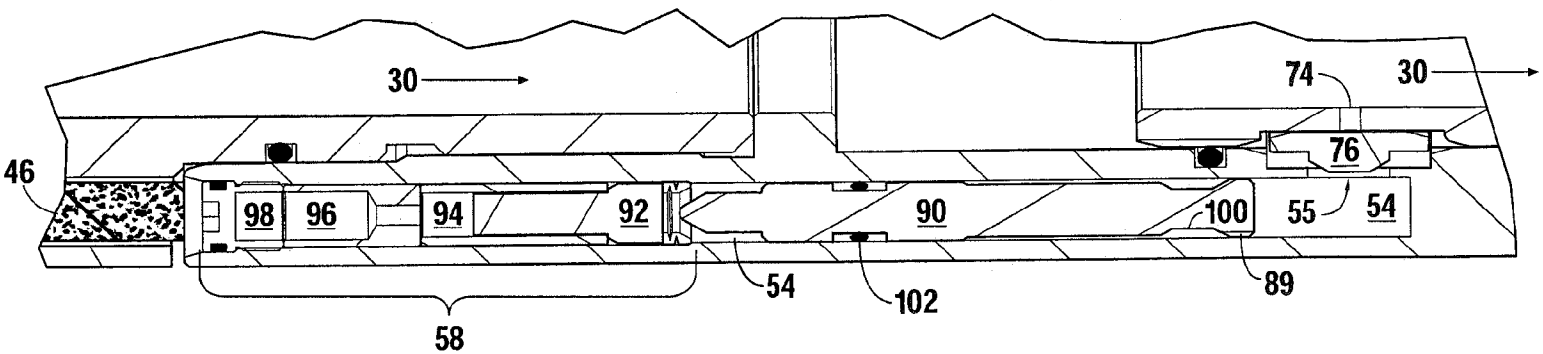
FIG. 7 is a sectional elevation of the firing assembly and pressure chamber shown in FIG. 5 wherein the firing pin has been released and has impacted the primer.

As shown in FIG. 7, pressure thereafter communicated into the pressure chamber 54 causes the firing pin 90 to move upwell because of the pressure differential above and below the sealing ring 102. In other words, because pressure upwell of the sealing element 102 is atmospheric, hydraulic pressure below the sealing element applies a hydraulic force on the second end 89 of the firing pin 90 resulting in upwell movement.

FIG. 7 shows the detonator assembly 58 with the pressure chamber 54 after the firing pin locking key 76 has released the firing pin 90 and at the point of contact of the firing pin 90 with the primer 92. The sealing ring 102 between the first end 88 and second end 89 of the firing pin 90 isolates pressure in the pressure chamber 54 upwell of the sealing ring 102 from the pressure in the flowpath 30. After ports 74 are aligned with the inlet 55, pressure within the flowpath 30 is communicated through the ports 74 into the pressure chamber 54 at a position below the sealing element 102, resulting in a pressure differential that moves the firing pin 90 upwell to contact and detonate the primer 92. Detonation of the primer 92 is contained by the case 94 and causes detonation of the adjacent shaped charge 96, which transfers explosive energy to the propellant volume 46, causing ignition thereof. The explosive energy is directed radially outwardly in the form of pressure waves through the circular ports 40 (see FIG. 1) and into the surrounding formation.

The present invention is described above in terms of a preferred illustrative embodiment of a specifically described team roping training apparatus. Those skilled in the art will recognize that alternative constructions of such an apparatus can be used in carrying out the present invention. Other aspects, features, and advantages of the present invention may be obtained from a study of this disclosure and the drawings, along with the appended claims.

We claim:

1. A downhole tool for stimulating a hydrocarbon-producing formation, the downhole tool comprising:

a first section having an internal sidewall defining at least a portion of a flowpath, and an outer sidewall;

a propellant volume having at least a portion within said first section;

an annular portion with at least one chamber having an end positioned adjacent to said propellant volume and an inlet;

at least one detonator assembly within said at least one chamber proximal to said end;

at least one firing pin within said at least one chamber, said at least one firing pin having a first end pressure isolated from a second end;

a second section at least partially separating said flowpath and the exterior of the downhole tool; and a sleeve assembly defining at least a portion of said flowpath and moveable between a first position and a second position, wherein in said first position said sleeve assembly is between the inlet of said at least one chamber and said flowpath.

2. The downhole tool of claim 1 wherein at least a portion of said propellant volume is between said internal sidewall and said outer sidewall.

3. The downhole tool of claim 2 wherein said at least one detonator assembly comprises a isolation bulkhead proximal to said propellant volume, a shaped charge adjacent said isolation bulkhead, a primer case adjacent said shaped charge, and a primer adjacent said primer case.

4. The downhole tool of claim 1 wherein said second section has at least one flow port defining a fluid communication path between said flowpath and the exterior of the downhole tool, and wherein in said first position said sleeve assembly is between said at least one flow port and said flowpath.

5. The downhole tool of claim 4 wherein said sleeve assembly comprises:

a piston sleeve having a sidewall and at least one port providing a communication path through said sidewall;

an insert sleeve engagable with said piston sleeve and having spaced-apart upper and lower sealing rings located upwell and downwell, respectively, of said at least one flow port when said sleeve assembly is in said first position; and an insert sleeve locking key coupling said insert sleeve to said piston sleeve when in said first position.

6. The downhole tool of claim 5 further comprising a firing pin locking key circumferentially disposed around said sleeve assembly, wherein in said first position said firing pin locking key is engaged with a retention groove circumferentially formed around said at least one firing pin, and wherein in said second position said firing pin locking key is disengaged from said retention groove.

7. The downhole tool of claim 6 wherein said sleeve assembly defines an outer groove circumferentially disposed therearound, and wherein in said second position:

said at least one port is substantially radially aligned with said inlet of said at least one chamber;

said firing pin locking key is positioned in said outer groove and disengaged from said at least one firing pin; and said piston sleeve is decoupled from said insert sleeve.

8. The downhole tool of claim 6 wherein:

said second section further comprises an inner shoulder adjacent a flanged section, said inner shoulder having a radius;

a piston locking key is positioned in said flanged section and disengaged from said insert sleeve when in said sleeve assembly is in said second position; and said radius of said shoulder is smaller than the radius of a bottom end of said piston sleeve to block movement of said sleeve below said shoulder.

9. The downhole tool of claim 5 wherein said insert sleeve further comprises a ball seat having an orifice defining a portion of said flowpath and engagable by a ball to substantially prevent fluid communication through said flowpath to below said insert sleeve.

10. The downhole tool of claim 5 wherein in said first position said insert sleeve is attached to said second section with a plurality of circumferentially aligned shear pins.

11. A downhole tool for stimulating a hydrocarbon-producing formation, the downhole tool comprising:

a mandrel defining at least a portion of a flowpath;

a propellant volume adjacent said mandrel;

a sleeve adjacent said propellant volume;

at least one detonator assembly adjacent to said propellant volume;

at least one firing pin operable to contact said at least one detonator assembly, said firing pin having a first end pressure isolated from a second end;

a housing; and a sleeve assembly moveable between a first position and a second position and defining a portion of said flowpath.

12. The downhole tool of claim 11 further comprising:

at least one flow port disposed through said housing; and wherein said sleeve assembly further comprises spaced-apart upper and lower sealing rings, wherein in said first position said upper and lower sealing rings are upwell and downwell, respectively, of said at least one flow port, and wherein in said second position said upper and lower sealing rings are below said at least one flow port.

13. The downhole tool of claim 12 wherein:

said propellant volume is circumferentially disposed around at least a portion of said mandrel; and said sleeve is circumferentially disposed around at least a portion of said propellant volume.

14. The downhole tool of claim 12 further comprising:

a middle sub having an annular portion, an upper end attached to said mandrel, and a lower end connected to said housing;

at least one chamber disposed within said annular portion, said at least one chamber having an end longitudinally adjacent to said propellant volume and an inlet; and wherein said at least one detonator assembly is located at said end of said at least one chamber and said at least one firing pin is located proximal to said inlet.

15. The downhole tool of claim 14 wherein said sleeve assembly comprises:

a piston sleeve having at least one port radially disposed therethrough, wherein in said first position said at least one port is substantially pressure-isolated from said at least one chamber, and wherein in said second position said at least one port is not substantially pressure-isolated from said at least one chamber;

an insert sleeve having said upper and lower rings circumferentially positioned above and below, respectively, said flow port when said sleeve assembly is in said first position; and an insert sleeve locking key disposed circumferentially around said piston sleeve, said insert sleeve locking key engaged with said insert sleeve when said piston sleeve is in said first position and disengaged with said insert sleeve in said second position.

16. The downhole tool claim 15 further comprising a firing pin locking key circumferentially disposed around said sleeve assembly, wherein in said first position said firing pin locking key is engaged with a retention groove circumferentially disposed around said at least one firing pin.

17. The downhole tool of claim 16 wherein said sleeve assembly defines an outer groove circumferentially disposed therearound, and wherein in said second position:

said at least one port is substantially radially aligned with said inlet of said at least one chamber;

said firing pin locking key is positioned in said outer groove and disengaged from said at least one firing pin; and said piston sleeve is decoupled from said insert sleeve.

18. The downhole tool of claim 17 wherein said insert sleeve further comprises a ball seat defining a portion of said flowpath and engagable by a ball to substantially prevent fluid communication to below said insert sleeve.

19. The downhole tool of claim 17 wherein in said first position said insert sleeve is attached to said housing with a plurality of shear pins.

20. The downhole tool of claim 11 further comprising:

a top connection attached to said mandrel and defining a portion of said flowpath; and a bottom connection attached to said housing and defining a portion of said flowpath.

21. The downhole tool of claim 11 wherein said at least one detonator assembly comprises an isolation bulkhead proximal to said propellant volume, a shaped charge adjacent said isolation bulkhead, a primer case adjacent said shaped charge, and a primer adjacent said primer case.

* * * * *

UNITED STATES PATENT AND TRADEMARK OFFICE

CERTIFICATE OF CORRECTION

PATENT NO. : 8,381,807 B2
APPLICATION NO. : 12/637225
DATED : February 26, 2013
INVENTOR(S) : Steven Jackson et al.

It is certified that error appears in the above-identified patent and that said Letters Patent is hereby corrected as shown below:

In the Specification:

Column 4, Line 41, insert the word --of-- after the word “Movement”.

Column 5, Line 9, delete the words “team roping training apparatus” and replace them with the following: “downhole tool”.

Signed and Sealed this
Sixteenth Day of July, 2013

Teresa Stanek Rea
*Acting Director of the United States Patent and Trademark Office*